US006761118B2

(12) United States Patent
Laucht et al.

(10) Patent No.: US 6,761,118 B2
(45) Date of Patent: Jul. 13, 2004

(54) METHOD OF PRODUCING AN IGNITER

(75) Inventors: Horst Laucht, Burckmühl (DE); Ernst Enzmann, Grassau (DE)

(73) Assignee: TRW Airbag Systems GmbH & Co. KG, Aschau (DE)

( * ) Notice: Subject to any disclaimer, the term of this patent is extended or adjusted under 35 U.S.C. 154(b) by 0 days.

(21) Appl. No.: 10/128,040

(22) Filed: Apr. 22, 2002

(65) Prior Publication Data

US 2002/0152919 A1 Oct. 24, 2002

(30) Foreign Application Priority Data

Apr. 23, 2001 (DE) ..... 101 19 769

(51) Int. Cl.[7] ..... C06D 5/00
(52) U.S. Cl. ..... 102/530; 86/1.1
(58) Field of Search ..... 102/530, 531, 102/202.5, 202.6, 202.7, 202.8, 202.9, 202.11, 202.12, 202.13, 202.14; 86/1.1; 280/741

(56) References Cited

U.S. PATENT DOCUMENTS 712,826 A * 11/1902 Mason ..... 102/202.6
4,735,145 A * 4/1988 Johnson et al. ..... 102/202.5
4,779,532 A * 10/1988 Riley et al. ..... 102/202.2
4,858,529 A 8/1989 Lieberman
5,593,181 A * 1/1997 Walker et al. ..... 280/741

FOREIGN PATENT DOCUMENTS

| | | | |
|---|---|---|---|
| DE | 685077 | C | 12/1939 |
| DE | 3920402 | A1 | 1/1991 |
| DE | 19841228 | A1 | 3/2000 |
| EP | 0847972 | A1 | 6/1998 |
| GB | 767896 | | 2/1957 |

* cited by examiner

*Primary Examiner*—Charles T. Jordan
*Assistant Examiner*—Susan C. Alimenti
(74) *Attorney, Agent, or Firm*—Tarolli, Sundheim, Covell & Tummino L.L.P.

(57) ABSTRACT

The invention relates to a method of producing an igniter for a gas generator. The igniter contains a charge sleeve which has an open end. The method comprising the following steps: A pyrotechnic ignition charge is introduced via the open end into the charge sleeve such that an edge of the charge sleeve projects axially at the open end with respect to the ignition charge. The projecting part of the edge is shortened axially, and the open end is closed. The invention further relates to a charge sleeve which has a weakened zone running along its periphery, or has a section which is able to be removed from the remainder of the charge sleeve.

10 Claims, 1 Drawing Sheet

METHOD OF PRODUCING AN IGNITER

TECHNICAL FIELD

The invention relates to a method of producing an igniter for a gas generator and also relates to a charge sleeve for such igniter.

BACKGROUND OF THE INVENTION

In igniters hitherto, a sleeve is inserted into the body of the igniter, which sleeve is sufficiently long to be able to receive a pyrotechnic ignition charge in the non-compressed state or as a suspension in fluid. By compressing the ignition charge or after evaporation of the solvent, the volume of the ignition charge is reduced, so that the edge of the sleeve projects axially with respect to the ignition charge. In further production, the sleeve is covered by a cap in order to close the sleeve. Hence, a cavity remains in the igniter, which is not filled by the ignition charge. This cavity increases the overall length of the igniter, which is a disadvantage especially with regard to the constant requirement for a reduction on the overall size of gas generators.

It is an object of the invention to provide an igniter with a small overall size.

BRIEF SUMMARY OF THE INVENTION

This is achieved by a method of producing an igniter for a gas generator, which comprises the following steps: A pyrotechnic ignition charge is introduced via the open end into the charge sleeve such that an edge of the charge sleeve projects axially at the open end with respect to the ignition charge. The projecting part of the edge is shortened axially, and the open end is closed. The ignition charge can therefore be introduced, as usual, in loose form or as a suspension, the large axial length of the charge sleeve being necessary in order to firstly receive the overall quantity of the ignition charge, which is required for the igniter. After the reduction of the volume of the ignition charge, the edge of the charge sleeve projects axially with respect to the ignition charge. As the projecting part of the edge is now no longer required, this edge is shortened axially, in order to eliminate the cavity which is not filled by the ignition charge. Then the open end of the charge sleeve is closed by conventional methods. The overall length of the igniter can be distinctly shortened by this method, a reduction in length of approximately 2 mm being able to be achieved.

In a preferred method according to the invention, the charge sleeve consists of two parts, one of the two parts being a removable ring which comprises the edge and is removed after the ignition charge has been introduced. The ring is preferably placed onto the second part of the charge sleeve. The advantage of such a removable ring lies in that the axial shortening of the charge sleeve takes place without vibrations and shocks, which could impair the consistency of the ignition charge or even lead to ignition.

In another preferred method according to the invention, the charge sleeve can have a weakened zone running along its periphery, and the axial shortening of the projecting part of the edge of the charge sleeve takes place in that the projecting edge is separated, broken off or torn off. Also in this process, no violent shocks and vibrations take place, which could alter the consistency of the ignition charge. Also, other methods for shortening the edge are, of course, conceivable.

Preferably, the ignition charge is compressed before the axial shortening of the charge sleeve, in order to keep the volume of the ignition charge as small as possible and to obtain a density capable of ignition. Thus, through an axial shortening of the charge sleeve, a maximum reduction to the overall size of the igniter can be achieved.

DETAILED DESCRIPTION OF THE PREFERRED EMBODIMENTS

Figure 1:
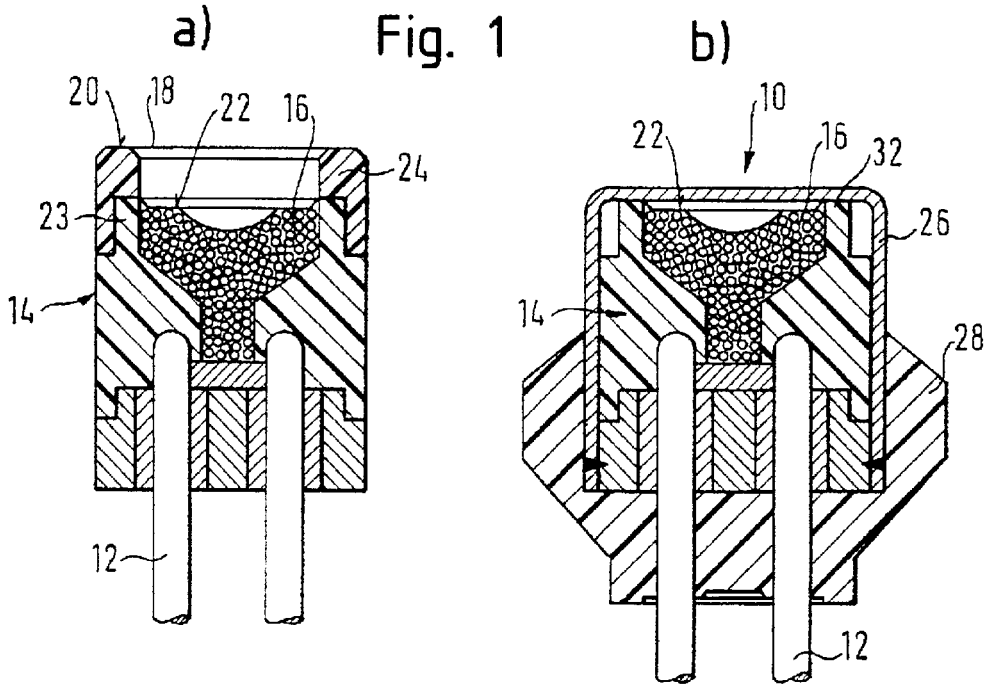
FIG. 1*a* shows an intermediate product in the production of an igniter with a two-part charge sleeve according to the invention in accordance with a first embodiment.
FIG. 1*b* shows the igniter of FIG. 1*a* after its completion.

FIGS. 1*a* and 1*b* show the carrying out of a first method according to the invention of producing an igniter. The intermediate product, shown in FIG. 1*a*, of an igniter 10 has in addition to the known components such as, for example, electric leads 12 or contact pins which can transfer an ignition pulse to the igniter 10, a charge sleeve 14, in the interior of which a pyrotechnic ignition charge 16 is introduced.

The ignition charge 16 is filled into the igniter via the open end 18 of the charge sleeve 14, the charge sleeve 14 firstly being able to be filled completely up to the edge 20. Then the ignition charge 16 is compressed, either by pressing together or by the solvent of a suspension being evaporated. After this step, the state shown in FIG. 1*a* is obtained, in which the edge 20 projects with respect to the ignition charge, more precisely with respect to its end face 22.

In a further method step, the charge sleeve 14 is shortened axially. In the first embodiment, the charge sleeve 14 is constructed in two parts, one part of the charge sleeve 14 being constructed as a ring 24 which is put into place and fixed in position laterally by a projection 23. The axial length of the ring 24 is selected such that it substantially corresponds to the distance of the end face 22 of the ignition charge 16 from the edge 20. In a subsequent method step, the ring 24 is now removed from the charge sleeve 14, so that the charge sleeve 14 is shortened axially.

Then the igniter 10 is provided with a cap 26 which closes off the open end 18 of the charge sleeve 14. The closure of the open end 18 can of course also take place in another known way. Finally, the igniter may also be embedded in a known way in a base 28, for instance by casting or injection-molding.

Figure 2:
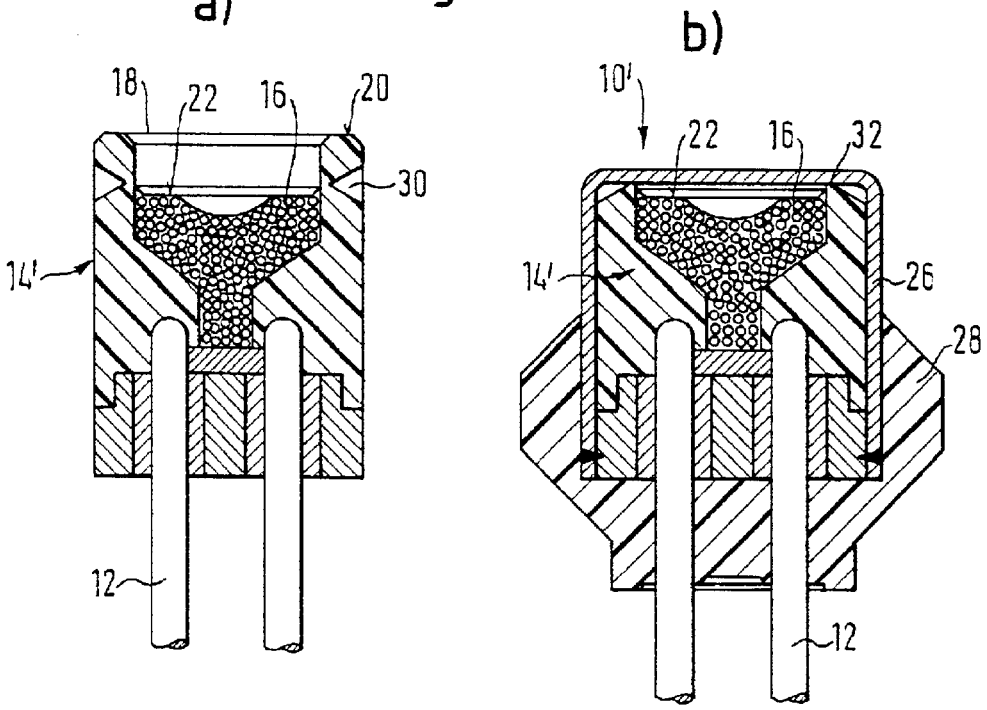
FIG. 2*a* shows an intermediate product in the production of an igniter according to the invention with a charge sleeve according to the invention in accordance with a second embodiment.
FIG. 2*b* shows the igniter of FIG. 2*a* after its completion.

In FIGS. 2*a* and 2*b* a further method according to the invention is shown, the components which are used coinciding substantially with those already known from FIG. 1*a* and 1*b*.

In contrast to the previously described method of producing the igniter 10, a one-piece charge sleeve 14' is used in the production of the igniter 10'. The charge sleeve 14' has a surrounding weakened zone 30 which forms a predetermined breaking point.

After the filling and compressing of the ignition charge 16, the charge sleeve 14 is severed, broken off or torn off at the weakened zone 30. By the removal of the projecting edge 20, an axial shortening of the charge sleeve 14' is produced. The weakened zone 30 preferably lies at the level of the end face 22 of the ignition charge 16, in order to be able to achieve a maximum axial shortening of the charge sleeve 14'. The new edge 32 of the open end 18, arising after the shortening of the charge sleeve 14', preferably terminates with the end face 22 of the ignition charge 16.

Subsequently, the igniter 10' is completed as described above.

What is claimed is:

1. A method of producing an igniter for a gas generator, said igniter containing a charge sleeve which has an open end, said method comprising the following steps:

a pyrotechnic ignition charge is introduced via said open end into said charge sleeve such that an edge of said charge sleeve projects axially at said open end with respect to said ignition charge, said projecting part of said edge is shortened axially by removing material of the projecting part of said edge, and said open end is closed after said edge is shortened.

2. The method according to claim 1, wherein said ignition charge is compressed before said axial shortening of said charge sleeve.

3. The method according to claim 1, wherein said projecting edge of said charge sleeve is severed.

4. The method according to claim 1, wherein said projecting edge of said charge sleeve is torn off.

5. The method according to claim 1, wherein said open end is closed by a cap.

6. The method according to claim 1, wherein said igniter is provided with a base.

7. A charge sleeve for an igniter of a gas generator, said charge sleeve comprising a periphery and being able to hold a pyrotechnic ignition charge, a weakened zone being provided which runs along said periphery of said charge sleeve.

8. A charge sleeve for an igniter of a gas generator, said charge sleeve being able to hold a pyrotechnic ignition charge and having a section which can be removed.

9. The charge sleeve according to claim 8, wherein said removable section of said charge sleeve is a ring which is put in place.

10. A method of producing an igniter for a gas generator, said igniter containing a charge sleeve which has an open end, said method comprising the following steps:

a pyrotechnic ignition charge is introduced via said open end into said charge sleeve such that an edge of said charge sleeve projects axially at said open end with respect to said ignition charge, said projecting part of said edge is shortened axially, and said open end is closed, wherein said charge sleeve consists of two parts, one of said two parts being a removable ring which comprises said edge and is removed after said ignition charge has been introduced.

* * * * *